US005100248A

United States Patent [19]

Cripe

[11] Patent Number: 5,100,248

[45] Date of Patent: Mar. 31, 1992

[54] TEXT SCALE METHOD

[75] Inventor: Brian E. Cripe, Corvallis, Oreg.

[73] Assignee: Hewlett-Packard Company, Palo Alto, Calif.

[21] Appl. No.: 522,410

[22] Filed: May 10, 1990

Related U.S. Application Data

[63] Continuation of Ser. No. 291,490, Dec. 8, 1988.

[51] Int. Cl.[5] ..... B41J 5/30

[52] U.S. Cl. ..... 400/76; 395/117

[58] Field of Search ..... 400/65, 121, 76; 384/518, 519, 523

[56] References Cited

U.S. PATENT DOCUMENTS

| | | | |
|---|---|---|---|
| 4,603,396 | 7/1986 | Washizuka | 364/518 |
| 4,608,664 | 8/1986 | Bartlett | 400/76 |
| 4,627,748 | 12/1986 | Mizuno | 364/520 |
| 4,642,779 | 2/1987 | Sawada | 364/520 |
| 4,698,624 | 10/1987 | Barker | 400/76 |
| 4,778,288 | 10/1988 | Nakamura | 400/76 |
| 4,799,172 | 1/1989 | Wood | 400/76 |
| 4,804,280 | 2/1989 | Kurokawa | 400/582 |
| 4,820,069 | 4/1989 | Torn | 400/555 |
| 4,963,042 | 10/1990 | Kawakami | 400/65 |
| 4,964,070 | 10/1990 | Markoff | 364/523 |

FOREIGN PATENT DOCUMENTS

| | | | |
|---|---|---|---|
| 87981 | 6/1982 | Japan | 400/583 |
| 131085 | 8/1983 | Japan | 400/555 |
| 106984 | 6/1984 | Japan | 400/582 |
| 132360 | 6/1986 | Japan | 400/555 |
| 44479 | 2/1987 | Japan | 400/65 |
| 87376 | 4/1987 | Japan | 400/555 |
| 238780 | 10/1987 | Japan | 400/630 |

OTHER PUBLICATIONS

IBM T.D. Bulletin, vol. 28, No. 10, Mar. 1986, pp. 4332–4336.

IBM T.D. Bulletin, vol. 28, No. 8, Jan. 1986, pp. 3629–3631.

*Primary Examiner*—David A. Wiecking

*Assistant Examiner*—Steven S. Kelley

[57] ABSTRACT

The invented text scale method features software which vertically repositions text to be printed on a page, thereby avoiding problems associated with unprintable regions. Graphics data to be printed is left unaltered. Repositioning is accomplished by recognizing the original vertical print position of a text character relative to the page on which it will be printed, and by then scaling such position by a predetermined percentage, thereby calculating a new vertical print position. By directly changing a text character's original vertical print position formatting features such as absolute vertical moves may still be employed.

17 Claims, 1 Drawing Sheet

TEXT SCALE METHOD

CROSS REFERENCE TO RELATED APPLICATION

This application is a continuation of application Ser. No. 07/291,490, filed Dec. 28, 1988, now abandoned.

TECHNICAL FIELD

This invention relates to a method used in formatting text to be printed on a page and, more particularly, to software capable of vertically repositioning text characters on a page. Repositioning of graphics is avoided.

BACKGROUND ART

Computer printers are often incapable of printing on certain regions of a page because of physical limitations such as paper handling. For example, Hewlett-Packard's DeskJet printer cannot print on the bottom 0.5-inch of a standard 8.5×11-inches sheet of paper. Accordingly, the DeskJet printer recognizes, on such a standard-size page, a printable region having a vertical dimension of 10.5-inches.

A user, however, often desires to print data in the unprintable regions. For example, a format of 66-lines per page and a spacing of 6-lines per inch is often mandated by various software applications. However, if the user sends a page to be printed with that format to the printer because of an unprintable region, the bottom lines of the text may be lost, dropped off or printed on the subsequent page.

To solve this problem, a printer's line spacing may be changed so that more lines per inch may be printed. Setting a line spacing to 6.5-lines per inch would allow 66 text lines to be printed within a printable region having a vertical dimension of 10.5-inches. For printers such as the DeskJet, this is a partial solution to the problem.

However, changing the line spacing is not a complete solution because it would only work where a printer advances the page on which the text is to be printed by line feed commands. If the software used in conjunction with the printer employs features such as absolute vertical moves, relative vertical moves or a vertical motion index, then changing the line spacing will cause the text characters positioned by such features to be misaligned.

For example, a feature such as an absolute vertical move positions a character on a page by an address identifying that character's position relative to the page size, not by line feed commands. Accordingly, irrespective of the line spacing, the printer will print the character at its address. If the line spacing has been changed, that position may be occupied by another character or misaligned in relation to other characters. In short, the character will not be positioned properly in the vertical direction.

This invention addresses the problem of nonprintable regions and overcomes the limitations of the prior art by providing a text scaling method which vertically repositions previously formatted text characters on a page without affecting the operability of software features such as absolute vertical moves.

As is implied by what has just been said, the method of the invention is specifically focused on repositioning text. Data relative to the printing of graphics is distinguished, and in no way altered, vis-a-vis repositioning, inasmuch as the kind of repositioning performed for text characters could result in significant, undesired distortion of graphics features.

DISCLOSURE OF THE INVENTION

The invented text scale method features software which vertically repositions text to be printed on a page so that problems resulting from unprintable regions are avoided. Repositioning is accomplished by recognizing the original vertical print position of a text character relative to the page on which it will be printed, and by then scaling such position by a predetermined percentage, thereby calculating a new vertical print position. By directly changing a text character's original vertical print position formatting features, such as absolute vertical moves, are unafffected.

BRIEF DESCRIPTION OF THE DRAWING

The single drawing FIGURE is a block diagram showing the text scale method of the invention.

DETAILED DESCRIPTION AND BEST MODE FOR CARRYING OUT THE INVENTION

Figure 1:
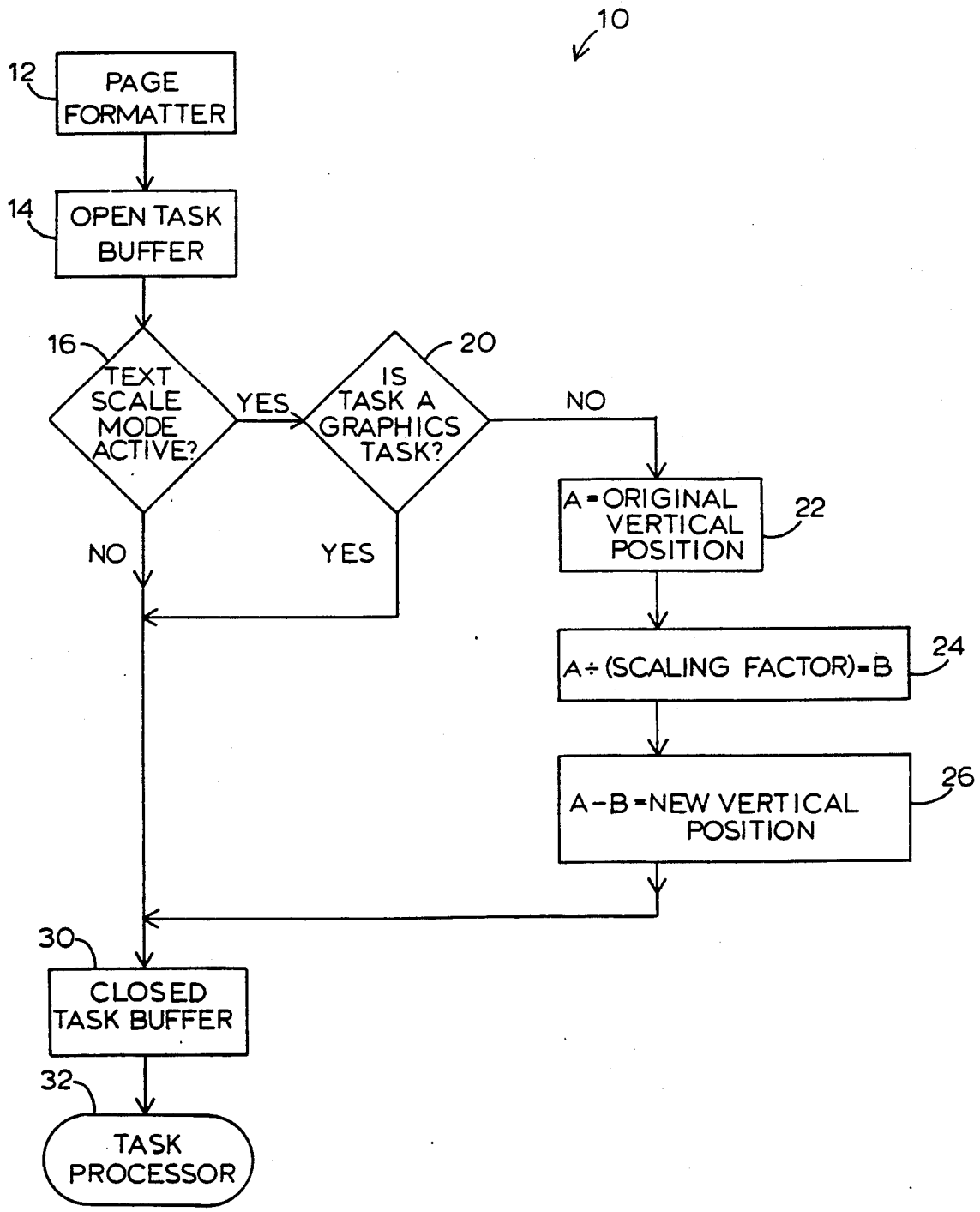

FIG. 1 shows generally at 10 a block diagram of the invented "Text Scale Method" as it would be incorporated in a printer. Initially, the printer receives a printing assignment including data describing characters to print. A page formatter 12 in the printer converts the data into the appropriate printer tasks and writes each task in an open task buffer, as signified by block 14.

The next step is to analyze the task and determine whether the text scale mode is active. In the preferred embodiment, the text scale mode is activated by a DIP-switch located on the printer. If the mode is not active, the task is conveyed to closed task buffer 30 and processed by task processer 32.

If the text scale mode is active, i.e., the user has chosen to use the text scale mode, then the next step in the invented method is to determine whether the task is a graphics task, as signified by block 20. Scaling a graphics figure would result in an overlap between the parts of the figure printed by different passes of the printhead. Accordingly, such figures would have a poor print quality if scaled. Therefore, if the task is a graphics task, the figures to be printed are not scaled.

If the task is not a graphics task, then the character described by the task is repositioned by first recognizing its original vertical print position, as shown by step 22. As used herein, "original vertical print position" means the distance from the top of the page on which the character will be printed down to the position where the character is initially intended to be printed. The print position is then scaled to produce a quotient representing the amount that it will be changed, as illustrated in step 24. In step 26, a new vertical print position is calculated by subtracting the quotient from the original vertical print position.

In the DeskJet printer, wherein the bottom 0.5-inch of a standard 8.5×11-inches page is an unprintable region, the original vertical print position should be reduced by a scaling factor of approximately 6%. Scaling an 11-inch page by 6% results in the 11-inches of text being printable within a region having a vertical dimension of 10.34-inches. Alternatively, subtracting 1/16th of the original vertical print position from such position would allow the DeskJet to print 11-inches of text, or 66-lines per page, within a printable region of 10.5-inches.

For example, consider the situation where the first line of text to be printed on an 8.5×11-inches page is at original vertical print position 0.5, or ½-inch from the top of the page. Scaling such position by 6% results in: 0.5–0.5 (0.06)=0.47. Thus, the first line of text would be printed 0.47-inches down the page, instead of 0.5-inches. A subsequent line of text may have an original vertical print position 5. Scaling such position by 6% results in: 5–5 (0.06)=4.7. Thus, that line will be printed at the new vertical print position of 4.7. The last line of text may have an original vertical position 11. Scaling that position results in: 11–11 (0.06)=10.34. Accordingly, 11-inches of text may be printed within a region having a vertical dimension of 10.34-inches. In this example, scaling by 6% is barely visible.

In the DeskJet printer, the scaling is most easily done in two steps, multiplying by 1/16th and then subtracting. However, in other applications, scaling may be performed by simply multiplying the original vertical print position by a certain percentage, i.e. 94%, and thereby eliminating the subtraction.

After the new vertical position has been calculated, it is employed to reposition the characters. The task is then conveyed to the closed task buffer, at step 30, subsequently routed to task processer 32 and then printed.

INDUSTRIAL APPLICABILITY

The above-described invention is applicable to the printer industry in that it scales certain text to be printed so that text characters originally positioned within an unprintable region are no longer lost. With this invention, only the position of the text characters to be printed would be scaled, not the size of the characters. Graphics applications would be misaligned if scaled and therefore are printed without scaling.

Again, this invention allows the vertical print position of text characters to be scaled while maintaining the usability of formatting features such as absolute vertical moves, relative vertical moves and a vertical motion index. As should now be evident, this invention could be used to scale any printed page size to any other.

While the preferred embodiment or best mode of the invention has been described herein, variations and changes may be made without departing from the spirit of the invention.

What is claimed is:

1. A method for vertically repositioning a predetermined number of lines of characters to be printed on a page without enlarging the characters, the method comprising:

recognizing the distances from the top of the page down to the positions where the characters comprising each line are initially intended to be printed;

scaling the distances by a predetermined percentage amount, thereby calculating new print positions for the characters of each line; and employing the new print positions to reposition the characters of each line vertically relative to the page.

2. The method of claim 1, wherein the step of scaling is performed without repositioning the characters horizontally relative to the page.

3. The method of claim 1, wherein the steps are all performed by a printer.

4. The method of claim 1, wherein the step of scaling comprises subtracting from the distances a predetermined percentage of the distances.

5. The method of claim 1, wherein the step of scaling comprises multiplying the distances by a predetermined percentage of the distances.

6. A text-scaling method whereby a predetermined number of lines of characters are repositioned on a page by a printer without enlarging the characters, said method comprising:

receiving a printing assignment which describes the lines of characters;

recognizing the distances from the top of page down to the positions where the characters comprising each line are initially intended to be printed;

scaling the distances by a predetermined percentage amount, thereby calculating new print positions for the characters of each line; and printing the characters of each line at the new print positions.

7. The method of claim 6, wherein the step of scaling is performed without repositioning the characters horizontally relative to the page.

8. The method of claim 6, wherein the step of scaling comprises subtracting from the distances a predetermined percentage of the distances.

9. The method of claim 6, wherein the step of scaling comprises multiplying the distances by a predetermined percentage of the distances.

10. A task-analyzing, graphics/text-differentiating, text-scaling method whereby text is repositioned on a page by a printer comprising:

receiving a printing assignment;

analyzing the assignment to determine if it is a graphics or a text task;

if the assignment is a graphics task, then printing the graphics;

if the assignment is a text task, then recognizing the distance from the top of the page down to the position where the text was initially intended to be printed, scaling the distance by a predetermined percentage of the distance, thereby calculating a new print position, and printing the text at its new print position.

11. The method of claim 10, wherein the step of scaling is performed without repositioning the characters horizontally relative to the page.

12. The method of claim 10, wherein the step of scaling comprises subtracting from the distance a predetermined percentage of the distance.

13. The method of claim 10, wherein the step of scaling comprises multiplying the distance by a predetermined percentage of the distance.

14. The text-scaling method whereby text is repositioned on a page by a printer, the method comprising:

receiving a printing assignment having a predetermined format from a software application;

analyzing the assignment to determine if it is a graphics or a text task;

if the assignment is a graphics task, then printing the graphics;

if the assignment is a text task, then recognizing the distance from the top of the page down to the position where at least part of the text was initially intended to be printed, scaling the distance by a predetermined percentage of the distance, thereby calculating a new print position, and printing at least part of the text at its new print position.

15. The method of claim 14, wherein the step of scaling is performed without repositioning the text horizontally relative to the page.

16. The method of claim 14, wherein the step of scaling comprises subtracting from the distance a predetermined percentage of the distance.

17. The method of claim 14, wherein the step of scaling comprises multiplying the distance by a predetermined percentage of the distance.

* * * * *